US005332867A

United States Patent [19]

Shaffer et al.

[11] Patent Number: 5,332,867

[45] Date of Patent: Jul. 26, 1994

[54] SEAL ASSEMBLY FOR SUPERCONDUCTING MAGNET TAPE OVENS

[75] Inventors: Frank D. Shaffer, Quimby; Malvin L. Dennis, Lake City, both of S.C.

[73] Assignee: General Electric Company, Milwaukee, Wis.

[21] Appl. No.: 923,427

[22] Filed: Aug. 3, 1992

[51] Int. Cl.[5] ..... H01B 17/26

[52] U.S. Cl. ..... 174/151; 277/121

[58] Field of Search ..... 174/151, 152 G, 77 R, 174/99 R, 93; 285/158; 277/121, 123, 103, 104, 112, 120, 121; 432/120

[56] References Cited

U.S. PATENT DOCUMENTS 3,660,590 5/1972 Conant ..... 174/47
3,859,574 1/1975 Brazier ..... 174/151 X
4,267,401 5/1981 Wilkinson ..... 174/77 R
5,235,138 8/1993 Shah et al. ..... 174/151

*Primary Examiner*—Lincoln Donovan
*Assistant Examiner*—Christopher Horgan
*Attorney, Agent, or Firm*—Irving Freedman; Robert R. Schroeder

[57] ABSTRACT

A detachable seal assembly for a pressurized constant process oven through which a flat filament is passed and which seals the oven against the environment surrounding the oven including a resilient aperture formed by opposed flaps which extend from a transverse portion in the direction of movement of the filament to sandwich the filament. Compression is provided to the seal assembly such that the friction of filament movement tends to stretch the flaps to seal the resilient aperture about the filament. The seal assembly includes a clamp to enable ready replacement to minimize process down time during replacement.

19 Claims, 2 Drawing Sheets

SEAL ASSEMBLY FOR SUPERCONDUCTING MAGNET TAPE OVENS

BACKGROUND OF THE INVENTION

This invention relates to a seal assembly for constant process ovens used in the manufacturing, such as the annealing, of ribbon or tape conductor used for superconducting magnets, and which allows the conductor to pass through the seal assembly while blocking out the surrounding atmosphere which would deleteriously affect the process.

As is well known, a magnet can be made superconducting by placing it in an extremely cold environment, such as by enclosing it in a cryostat or pressure vessel containing liquid helium or other cryogen. The extreme cold reduces the resistance in the magnet coils to negligible levels, such that when a power source is initially connected to the coil (for a period, for example, of ten minutes) to introduce a current flow through the coils, the current will continue to flow through the coils due to the negligible resistance even after power is removed, thereby maintaining a magnetic field. Superconducting magnets find wide application, for example, in the field of magnetic resonance imaging.

Because of the extreme thermal and electromagnetic forces encountered by coils in superconducting magnets, unique ribbon or tape conductors are fabricated and used. The manufacturing process typically includes passing the tape conductor through a plurality of ovens during the manufacturing process, including, for example, coating, decomposition, and reaction anneal ovens. The manufacturing process is typically a constant process in which the tape is sequentially passed through the various manufacturing processing ovens. However, during such processing it is important that the air or atmosphere surrounding each oven, and in particular the oxygen in the air, be excluded from the ovens since oxygen could cause reactions which would deleteriously affect the ability of the tape conductor to meet the stringent requirements for superconducting magnet conductors.

An inert gas such as argon is typically maintained at a pressure within the oven to further insure against introduction of air. As a result, a seal is also required at the exit of each oven. The principal difficulty with such seals is that while the tape conductor must pass freely through the seals, the surrounding atmosphere must be blocked from passing through even in the presence of dross or other imperfections in the dimensions of the tape. Also, while a tight seal is required, the seal must exhibit resistance to wear and enlargement of the opening through which the tape conductor passes, which would then result in the loss of considerable inert gas from within the pressurized oven, and/or the introduction of oxygen into the oven. In a typical oven, such as a reaction anneal oven, the oven temperature is in the range of over 1000° C.

Conventional seals after a period of use, exhibit wear and enable considerable leakage, resulting in the release of argon gas through the seals into the work area surrounding the ovens and the need to continuously replenish the argon gas within the oven.

As a result, it is important that seals for such ovens readily enable the tape conductor to pass through the oven, provide the best seal possible, and maintain sealing integrity over an extended period of use, even in the presence of wear through the continuous passage of the tape conductor through the seal. These requirements must be met even though a superconducting tape is a fragile foil in the order of 1 mil thick which acts somewhat like a continuous razor blade passing through the seal.

In addition, since such seals are utilized in continuous processing of superconducting tape conductors, it is important that the seals be readily and quickly replaceable to minimize manufacturing downtime when a seal replacement becomes necessary.

OBJECTS AND SUMMARY OF INVENTION

Accordingly, it is an object of the present invention to provide an improved seal assembly for pressurized continuous process ovens used in the manufacture of conductor tape for superconducting magnets which allows the tape to pass through while preventing leakage between the oven and the surrounding atmosphere.

It is another object of the present invention to provide an improved seal assembly for pressurized continuous process ovens used in the manufacture of conductor tape for superconducting magnets which resists wear, yet maintains an effective seal over an extended period of time even in the presence of wear.

It is still another object of the present invention to provide an improved seal assembly for pressurized continuous process ovens used in the manufacture of conductor tape for superconducting magnets which is readily replaceable, minimizing the downtime periods of the manufacturing process during the replacement of the seal assembly.

In accordance with a preferred embodiment of the present invention, a detachable seal assembly is provided for pressurized continuous process ovens used in processing superconducting magnet tape conductor which passes through the seal. The seal assembly is detachable, and includes at least two flexible members having opposed surfaces extending in the direction of movement of the tape and forming a planar surface transverse to the direction of movement of the tape. The flexible members are compressed between an end plate and a transition flange which includes toggle clamps for readily and detachably securing the seal assembly to an end flange on the oven. An O-ring is positioned between the seal assembly and the oven end flange in an annular groove in the transition flange. The seal assembly may include a plurality of silicone rubber layers contiguous to the flexible members with apertures of different sizes through which the opposed surfaces of the flexible members pass. The tape conductor passes through the seal and exits between the opposed flap surfaces with the movement of the tape tending to stretch the flexible flaps to seal or close the opening between the flexible members through which the tape conductor passes.

BRIEF DESCRIPTION OF INVENTION

Figure 1:
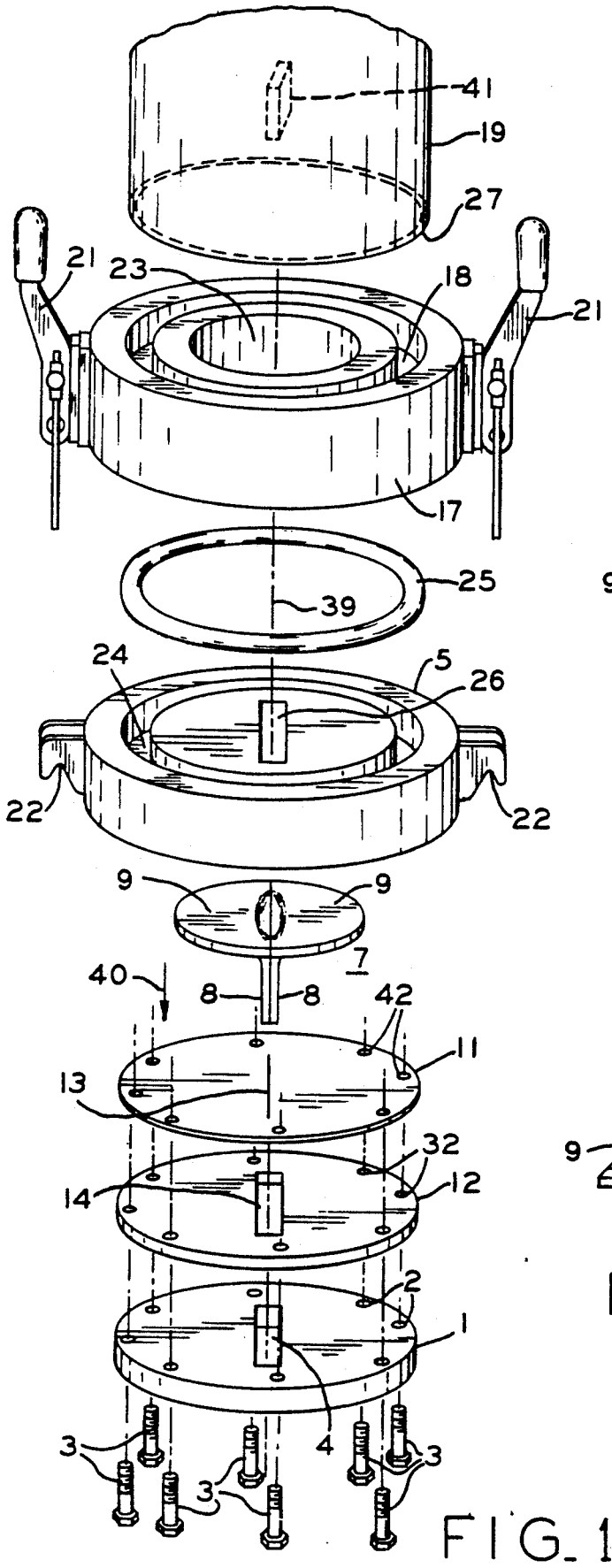
FIG. 1 is an exploded view showing a preferred embodiment of the invention.
Figure 2:
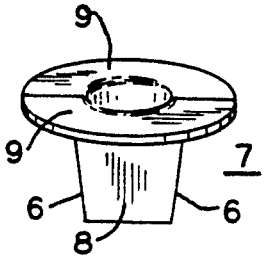
FIG. 2 is a side view of the seal flaps of FIG. 1.
Figure 3:
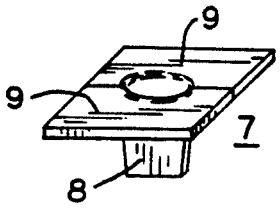
FIG. 3 shows an alternate embodiment of the seal flaps of FIGS. 1 and 2.
Figure 4:
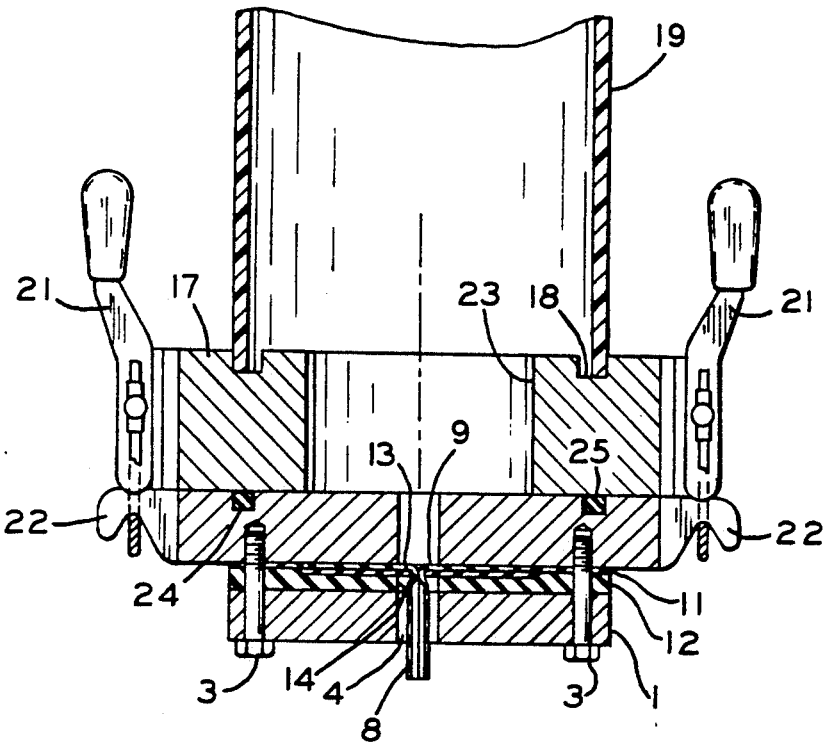
FIG. 4 is an enlarged cross-sectional view of a portion of FIG. 1 showing the mechanism for detachably securing the seal assembly to the oven.

Referring first to FIGS. 1, 2 and 4, end member 1 includes a plurality of spaced apertures such as 2 through which bolts such as 3 pass, and a centrally located rectangular aperture 4.

Flap assembly 7 includes a pair of contiguous members having opposed surfaces 8 and planar surfaces 9 formed by bending the planar surfaces orthagonal to the opposed surfaces. Seal flap assembly 7 includes tapered sides 6 of flaps 8 which in the assembled position, extend through aperture 4 of end member 1. A pair of silicone rubber layers 11 and 12 are positioned between planar surfaces 9 of seal flaps 7 and end member 1 to provide a more positive seal between the end member and transition flange 5. Flexible base plate 12 is fabricated of silicone rubber 0.125 inches thick, while restriction layer 11 is fabricated from silicone rubber 0.030 inches thick. Flexible base plate 12 includes centrally located rectangular aperture 14, while restriction layer 11 includes centrally located aperture 13. Rectangular apertures 4 of end member 1, 14 of flexible base plate 12, and 13 of restriction layer 11 are of decreasing width. Aperture 13 must be stretched in order to insert the opposed flaps 8 of seal flap member 7 such that the seal flap member is retained and maintained in position within flexible restriction layer 11. Flaps 8 may then be-readily inserted through wider aperture 14 of flexible base plate 12 and aperture 4 of end member 1.

The subassembly is then assembled by passing bolts 3 through apertures such as 2, 32 and 42 in end member 1, flexible base plate 12, and flexible restriction layer 11, respectively, into threaded apertures (not shown) in transition flange 5. When bolts 3 are tightened into transition flange 5, end member 1 compresses flexible base plate 12, flexible restriction layer 11 and planar surface 9 of seal flap assembly 7, all of which are sandwiched between the end member and the transition flange.

The replaceable seal assembly 30 described above may then be readily attached or detached to the oven tube 19 through oven end flange 17 in the manner described below.

Transition flange 5 includes a plurality of fixed toggle members 22 about the periphery thereof, annular groove 24 in which O-ring 25 is placed, and centrally located aperture 26.

Oven end flange 17 includes a central opening 23 and an annular groove 18 at its upper end, which is dimensioned to fit around the end 27 of oven tube or passageway 19, to which it is attached and sealed by RTV silicone rubber. A plurality of moveable toggle clamps 21 are positioned around oven end flange 17 to mate with fixed toggles 22 on transition flange 5 to detachably affix replaceable seal subassembly 30 to oven end flange 17, and to enable the subassembly 30 to be readily removed from the oven end flange and a substitute replaceable seal assembly quickly substituted.

The present invention thus provides a quick-disconnect and replacement feature utilizing mating toggles 21 and 22, with O-ring 25 providing sealing between transition flange 5 and oven end flange 17. The multi-layer seal, including flexible restriction layer 11 and flexible base plate 12, provides compression adjustability. Aperture 13 in restriction layer 11 is flexible to accomodate the passage of large size abnormalities through the seal without exerting extreme or damaging forces on the conductor tape or the seal. Abnormalities could, for example, include dross which has not been removed from tape conductor or filament 41.

Thus, seal assembly 7 is compliant to accommodate for such abnormalities without the creation of forces which could damage either (or both) the seal or the tape conductor. Of significance are seal flaps 8, which provide a wear surface that is both durable, compliant and conforming. As tape conductor 41 moves through seal assembly 7 in the direction of arrows 40, that is, past planar surface 9 of seal .flap member 7, and subsequently between flaps 8, the frictional forces of the movement of the tape between and past resilient flaps 8 exerts a pressure on the flaps which tends to pull or stretch the flaps in the direction of movement of the tape conductor, which in turn tends to force surfaces 9 and flaps 8 of seal flap member 7 toward one another to more closely conform and hug the tape conductor passing between them. This conforming compensates for wear, providing a relatively long life and efficient operation to the seal. Moreover, the present invention facilitates the ready replacement of the seal when it becomes necessary through replacement of seal subassembly 30 with a substitute spare unit, and/or the disassembly of seal subassembly 30 and replacement of seal flap assembly 7.

Thus, the present invention resists yet accommodates for wear in the seal, maintains an effective seal over an extended period of time, and is readily replaceable without shutting down the manufacturing process for any lengthy period of time.

While the present invention has been described with respect to certain preferred embodiments thereof, it is to be understood that numerous variations in the details of construction, the arrangement and combination of parts, and type of materials used may be made without departing from the spirit and scope of the invention.

What we claim is:

1. A replaceable seal for a pressurized constant process oven through which a filament is passed and which seals the interior of the oven from the surrounding atmosphere during the movement of the filament through the oven and adapted to conform to the passage of abnormalities in the filament through the seal comprising:

an end member including a first aperture therethrough;

at least two opposed flexible members passing through said first aperture including opposed flap surfaces extending in the direction of said movement of said filament and forming a resilient second aperture therebetween and a planar surface transverse to said direction of movement; and said resilient aperture conforming to and enabling the passage of abnormalities therethrough;

means to selectively compress said planar surface to enable installation and replacement of said resilient second aperture;

said movement of said filament being sequentially through said resilient aperture and between said opposed flexible members in a direction tending to close said resilient aperture about said filament through the friction generated by the movement of said filament against said flap surfaces.

2. The seal for a pressurized constant process oven of claim 1 wherein a resilient member is positioned contiguous to said planar surface with a transverse third aperture through said opposed surfaces are passed during said installation and replacement.

3. A seal for a pressurized constant process oven through which a filament is passed and which seals the interior of the oven from the surrounding atmosphere comprising:

an end member including a first aperture therethrough;

at least two opposed flexible members passing through said first aperture including opposed flap surfaces extending in the direction of movement of said filament and forming a resilient second aperture therebetween and a planar surface transverse to said direction or movement;

means to compress said planar surface;

said movement of said filament being sequentially through said resilient second aperture and between said opposed flexible members in a direction tending to close said resilient second aperture about said filament;

a resilient member positioned contiguous to said planar surface with a transverse third aperture through which said opposed surfaces pass; and wherein a transition flange is provided which is detachably fastened to said oven, and to which said end member is secured with said resilient member and said flexible members sandwiched therebetween and forming a seal assembly.

4. The seal for a pressurized constant process oven of claim 3 wherein said means to compress said planar surface comprises fasteners passing between said transition flange and said detachable end member.

5. The seal for a pressurized constant process oven of claim 4 wherein said oven includes:

a passageway through which said filament is passed;

an oven end flange including an opening therethrough secured to said passageway; and clamps to detachably secure said seal assembly to said oven end flange.

6. The seal for a pressurized constant process oven of claim 5 wherein a compressible O-ring is positioned between said seal assembly and said oven end flange.

7. The seal for a pressurized constant process oven of claim 6 wherein toggle clamps are provided to facilitate the detachable securing of said seal assembly to said oven end flange.

8. The seal for a pressurized constant process oven of claim 7 wherein said transition flange includes an annular groove in which said O-ring is positioned.

9. The seal for a pressurized constant process oven of claim 2 wherein:

said resilient member includes a first layer with a fourth aperture therethrough and a second restriction layer with said third aperture therethrough for the passage of said filament; and said third aperture in said restriction layer is smaller than said third aperture and closely conforms to the thickness of said opposed flap surfaces.

10. The seal for a pressurized constant process oven of claim 9 wherein said filament is a an electrical tape conductor having a substantially rectangular cross-section.

11. The seal for a pressurized constant process oven of claim 10 wherein said apertures are substantially rectangular in cross-section to accommodate the movement of said electrical tape conductor therethrough.

12. The seal for a pressurized constant process oven of claim 2 wherein movement of said filament between said opposed surfaces extending in the direction of movement of said filament tends to stretch said opposed surfaces and move said opposed surfaces against said filament, closing the aperture formed between said opposed surfaces.

13. The seal for a pressurized constant process oven of claim 12 wherein:

said filament is a flat electrical conductor; and said apertures are substantially rectangular in cross-section to conform to the electrical conductor.

14. A seal for a pressurized constant process oven through which a flat conductor is passed and which seals the interior of the oven from the surrounding atmosphere comprising:

an end member including a first aperture therethrough;

at least two opposed flexible members passing through said first aperture including opposed planar flap surfaces extending in the direction of movement of said flat conductor and forming a resilient elongated aperture therebetween and a planar surface transverse to said direction of movement; and means to compress said planar surface;

said movement of said flat conductor being sequentially through said resilient aperture and between said opposed flexible members with the friction of the movement of said flat conductor against said planar flap surfaces tending to stretch said opposed surfaces against said flat moving conductor to maintain a resilient aperture about said flat conductor which conforms to abnormalities in said flat conductor.

15. The seal for a pressurized constant process oven of claim 14 wherein a resilient member is positioned contiguous to said planar surface with a transverse rectangular and resilient aperture through which said opposed surfaces are positioned and pressed together.

16. A seal for a pressurized constant process oven through which a flat conductor is passed and which seals the interior of the oven from the surrounding atmosphere comprising:

an end member including a first aperture therethrough;

at least two opposed flexible members passing through said first aperture including opposed flap surfaces extending in the direction of movement of said flat conductor and forming a resilient elongated second aperture therebetween and a planar surface transverse to said direction of movement;

means to compress said planar surface;

said movement of said flat conductor being sequentially through said resilient aperture and between said opposed flexible members tending to stretch said opposed surfaces against said flat conductor and maintain a resilient aperture about said flat conductor;

a resilient member positioned contiguous to said planar surface with a transverse rectangular and resilient third aperture through which said opposed surfaces are positioned and pressed together;

a transition flange detachably fastened to said oven;

said end member is secured to said transition flange with said resilient member and said flexible members sandwiched and compressed therebetween and forming a seal assembly;

said oven includes a passageway through which said flat conductor moves;

an oven end flange including an opening therethrough secured to said tube; and clamps to detachably secure said transition flange to said oven end flange.

17. The seal for a pressurized constant process oven of claim 16 wherein:

said transition flange includes an annular groove; and a compressible O-ring is positioned between said seal assembly and said oven end flange.

18. The seal for a pressurized constant process oven of claim 17 wherein toggle clamps are provided to detachably secure said transition flange to said oven end flange.

19. The seal for a pressurized constant process oven of claim 15 wherein:

said resilient member includes a first layer with a fourth rectangular aperture therethrough and a second restriction layer with a fifth rectangular aperture therethrough for the passage of said flat conductor; and said fourth aperture in said restriction layer is smaller than said third aperture and closely conforms to the thickness of said opposed flap surfaces.

* * * * *